United States Patent [19]

Soeno et al.

[11] 4,129,801

[45] Dec. 12, 1978

[54] CATHODE FOR CATHODE RAY TUBE OF DIRECTLY HEATING TYPE AND PROCESS FOR PRODUCING THE SAME CATHODE

[75] Inventors: Ko Soeno, Hitachi; Tomio Iizuka, Ibaraki; Toshio Doi; Hisashi Ando, both of Hitachi; Testuo Oyama, Takahagi; Hiroshi Sakamoto, Hitachi; Akira Misumi, Mobara, all of Japan

[73] Assignee: Hitachi, Ltd., Japan

[21] Appl. No.: 813,240

[22] Filed: Jul. 6, 1977

[30] Foreign Application Priority Data

Jul. 7, 1976 [JP] Japan ..... 51-79964

[51] Int. Cl.[2] ..... H01J 19/06; H01J 9/04

[52] U.S. Cl. ..... 313/346 R; 313/311

[58] Field of Search ..... 313/346, 311

[56] References Cited

U.S. PATENT DOCUMENTS

| | | | |
|---|---|---|---|
| 3,257,703 | 6/1966 | Coad et al. | 313/346 R X |
| 3,374,385 | 3/1968 | Lattimer | 313/346 R X |
| 3,694,688 | 9/1972 | Kuiper et al. | 313/346 DC |

*Primary Examiner*—Alfred E. Smith
*Assistant Examiner*—Charles F. Roberts
*Attorney, Agent, or Firm*—Craig & Antonelli

[57] ABSTRACT

The present cathode for cathode ray tube of directly heating type is characterized by comprising a cathode substrate body having two leg pieces extended in the same direction and a flat part connected to one end of each leg piece, prepared by shaping a flat metal plate of nickel- or cobalt-based alloy, a bonding layer having an uneven surface prepared by diffusion bonding by heating a powder layer comprising powders of alloy or mixture of nickel and cobalt formed on the flat part, to which a thermionic emission layer is to be bonded, and the thermionic emission layer, and has a very small deformation when used and a longer life.

A cathode with much less deformation and much longer life can be obtained by using a cathode substrate body prepared from a flat metal plate provided with a thinner metal layer of at least one of nickel and cobalt on its surface than the flat metal plate by diffusion bonding.

A cathode with much less deformation after the service for a long period and much longer life is obtained by using a cathode substrate body prepared from a flat metal plate provided with a metal layer of at least one of nickel and cobalt having a smaller thickness on its surface than that of the flat metal plate by diffusion bonding, and then applying a plastic working to the flat metal plate to a desired thickness.

29 Claims, 4 Drawing Figures

CATHODE FOR CATHODE RAY TUBE OF DIRECTLY HEATING TYPE AND PROCESS FOR PRODUCING THE SAME CATHODE

This invention relates to a process for producing a novel cathode for a cathode ray tube of directly heating type having a very small thermal deformation and a process for producing the same cathode.

Cathode ray tubes of directly heating type have less power consumption and considerably shorter starting time from a switch-on of power source to actuation than cathode ray tubes of indirectly heating type, but on the other hand in the cathode ray tubes of directly heating type, an electric current is directly passed through the cathode that emits electron beams, and thus the cathode is rapidly heated and is very liable to undergo thermal deformation. Once the cathode undergoes thermal deformation, the cathode ray tubes fail to exhibit desired characteristics, which is a fatal trouble to the cathode ray tubes.

Description of the invention and the prior art will be made, referring to the accompanying drawings.

Figure 1:
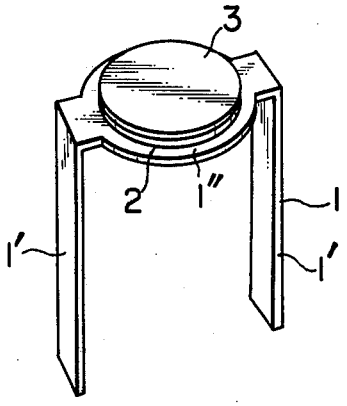

FIG. 1 is a schematic view of a general structure of a cathode for a cathode ray tube of directly heating type.

Figure 2A:
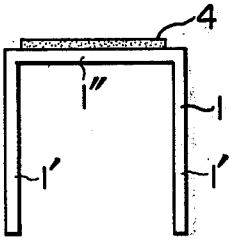
Figure 2B:
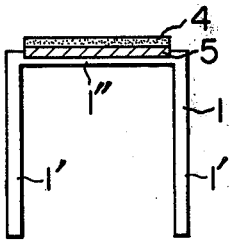

FIG. 2(*a*) and (*b*) are view showing formation of a diffusion layer between a cathode substrate body and Ni powders.

Figure 3:
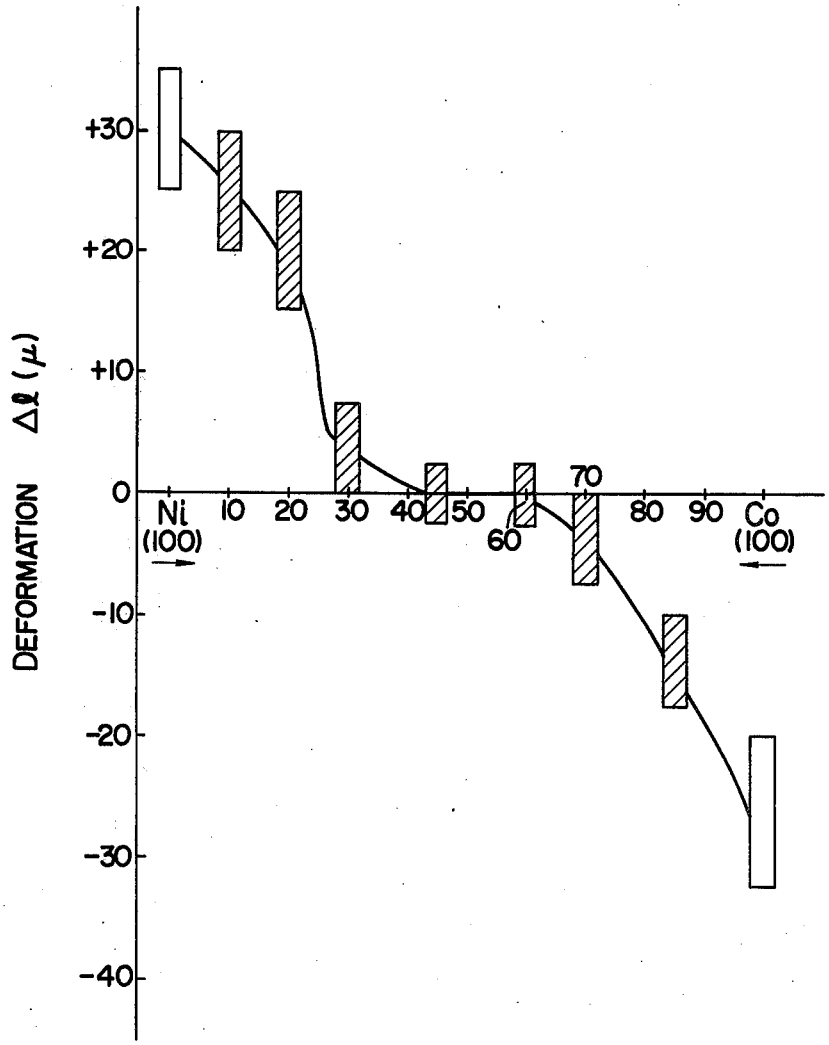

FIG. 3 is a graph showing influences of Co-Ni composition upon thermal deformation referring to Examples.

In a cathode of ordinary cathode ray tube of directly heating type, a cathode substrate body 1 (leg pieces 1' and flat part 1'') is firmly bonded to a thermionic emission layer 3 through a bonding layer 2, as shown in FIG. 1. Electric current is directly passed through the cathode substrate body, and thus the substrate body is heated to a high temperature (about 650° to 1,000° C.). That is, the substrate body must have a high strength at the high temperature, and also have an appropriate electric resistance on account of the necessity for heating by the electric current passage, and a good cold processability, as well as the substrate body must be produced easily.

Thus, an alloy of the following system of 15 to 30% by weight of W, 0.1 to 1.5% by weight of Zr, and the balance being Ni, or said alloy, a portion or all the portion of whose Ni is replaced with Co similar to Ni, or a portion or all the portion of whose W is replaced with Mo has been generally deemed to be most appropriate for the cathode substrate body.

On the other hand, the thermionic emission layer is a compound oxide obtained by calcining compound carbonates of barium, strontium, and calcium [(Ba, Sr, Ca) $CO_3$] at a high temperature, for example, about 800° to 1,000° C. Zr contained in a small amount in the cathode substrate body acts upon the compound oxide as a reducing agent, and plays a role to facilitate the thermionic emission. The bonding layer makes a bonding between the cathode substrate body and the thermionic emission layer firm, and is most effectively formed by applying pure Ni powders onto the cathode substrate body and baking the resulting substrate body. That is, a cathode of directly heating type is usually produced by applying pure Ni powders onto said cathode substrate body to a thickness of 1 to 5 mg/cm$^2$, heating the applied substrate body in vacuum at a temperature of about 700° to about 900° C., thereby baking the Ni powders onto the cathode substrate body, applying compound carbonate of barium, strontium and calcium [(Ba, Sr, Ca) $CO_3$] to the baked substrate body, after cooling, to a thickness of 1 to 5 mg/cm$^2$, and again heating the applied substrate body in vacuum at a temperature of about 800° to about 1,000° C., thereby forming compound oxides and firmly bonding the oxides to the cathode substrate body.

However, it is observed in said process that a thermal deformation takes place at the cathode during the production or during the service, and it is the most important problem in the production of the cathode ray tubes of directly heating type to prevent the thermal deformation of the cathode.

An object of the present invention is to provide a cathode of directly heating type free from thermal deformation during the production or service of the cathode, and a process for producing the same cathode.

The present invention has been accomplished on the basis of the following findings.

As a result of studies on the deformation of cathode, the present inventors have found the following three facts. That is, (1) when pure Ni powders are applied to the cathode substrate body, and baked, such a deformation takes place as to elongate the Ni powders baked surface of the cathode, (2) when the compound carbonate is applied to the cathode substrate body after the baking of Ni powder and then baked to compound oxides, such a deformation takes place as to elongate the compound oxides-baked surface of the cathode, and (3) even during the service as a cathode ray tube of directly heating type, such a deformation takes place as to elongate the Ni powders and compound oxides-baked surface of the cathode, but the deformation is completely discontinued after the continuous service for about 20 to about 30 hours.

It has been clarified that such deformation of the cathode is basically caused by a progress of mutual diffusion between the cathode substrate body of alloy of 15 to 30% by weight of W and 0.1 to 1.5% by weight of Zr, the balance being Ni, and the baked Ni powders. That is, when the Ni powders are baked onto the cathode substrate body, W and Zr in the cathode substrate body diffuse into the baked Ni powder layer, and also Ni diffuses into the cathode substrate body, whereby a diffusion layer is formed between the baked Ni powder layer and the cathode substrate body. The resulting state is given in FIG. 2, where FIG. 2 (*a*) shows a state of the Ni powders 4 being applied onto the ccathode substrate body 1, and FIG. 2 (*b*) a state of a diffusion layer 5 being formed between the cathode substrate body 1 and the Ni powders (Ni layer) 4. The coefficient of thermal expansion of the diffusion layer shown in FIG. 2 (*b*) is larger than that of the cathode substrate body, and besides the deformation due to the difference in the coefficients of thermal expansion, it has been found that a deformation due to differences in diffusion coefficients of Ni and W is superposed thereon. That is, the diffusion coefficient of Ni from the Ni powder layer to the cathode substrate body is about three times as large as that of W from the cathode substrate body to the Ni powder layer. Therefore, the cathode substrate body in contact with the Ni powder layer receives Ni diffusing from the Ni powder layer, forming many pores, and consequently expands.

It is recognized in the present invention that, when powders of Co similar to Ni in chemical properties are baked onto the cathode substrate body in place of the Ni powders, a thermal deformation reversed to that of the baked Ni powders, that is, such a thermal deformation that the Co powders-baked side of the cathode substrate body is contracted, takes place, the composite oxide constituting the thermionic emission layer and Co have a very good adhesiveness therebetween.

The present invention is based on such a finding, and provides a cathode for cathode ray tube of directly heating type, where a Ni-based or Co-based alloy, particularly an alloy of 15 to 30% by weight of W, 0.1 to 1.5% by weight of Zr, the balance being Ni, or said alloy, a portion or all the portion of whose Ni is replaced with Co, is used as the cathode substrate body, characterized by providing a layer of powders of Ni-Co alloy or powdery mixture of Ni and Co on the surface of cathode substrate body, and heating the substrate body, thereby diffusing Ni and Co into the cathode substrate body.

In the present invention, the cathode substrate body is comprised of an alloy of 15 to 30% by weight of W and 0.1 to 1.5% by weight of Zr, the balance being Ni, or said alloy, a portion or all the portion of whose Ni is replaced by Co. A cathode substrate body 1 of the shape shown in FIG. 1 is prepared from a metallic flat plate of the alloy by punching, and a layer of powders of Ni-Co alloy or powdery mixture of Ni and Co is provided as a bonding layer 2 on the surface of the cathode substrate body. The bonding layer may be provided only at the side at which a thermionic emission layer is provided, but can be provided at both sides of the cathode substrate body, since it is necessary to take into account a thermal deformation of the cathode due to differences in coefficients of thermal expansion among the cathode substrate body, the diffusion layer, and the Ni and Co power layer.

Composition ratio of powders of Ni-Co alloy or powdery mixture of Ni and Co has no special difference between the case of using the powders of alloy and the case of using the powdery mixture of Ni and Co. It is preferable in view of the degree of bending of the cathode due to the thermal deformation that Ni is in a range of 65 to 35% by weight and Co 35 to 65% by weight. The powder layer may be provided by laying the layer in a powdery state, but can be provided by applying a slurry or paste of the powders in a medium having no effect upon the successive diffusion treatment to the cathode substrate layer, and drying the applied slurry or paste. Sufficient thickness of the powder layer is about 2 to 5 mg/cm$^2$.

Then, the cathode substrate body provided with said powder layer is heated in vacuum, for example, at 900° C. for 30 minutes to bake the powders onto the cathode substrate body to diffuse Ni and Co into the cathode substrate body. Thermal deformation of the cathode substrate body by the successive heating when the thermionic emission layer is provided and by the heating just after it is put into service can be prevented by said diffusion treatment.

A coating solution of composite carbonates of, for example, barium, strontium and calcium (the coating solution prepared by mixing 100 g of nitrocellulose and 100 l of butyl acetate with 100 g of the carbonates in a ball mill for 40 hours) is applied to the cathode substrate body subjected to said diffusion treatment, and then the cathode substrate body is calcined at an elevated temperature to form a thermionic emission layer as their composite oxides.

The use of the powders of Ni-Co alloy or powdery mixture of Ni and Co in the present invention provides prevention of deformation by offsetting deformations due to mutual diffusion, that is, by simultaneous use of Ni and Co having mutually reversed actions to the thermal deformation of the cathode substrate body. That is, in the mutual diffusion of the Co powder layer and the substrate metal, Co atoms diffuse into the substrate metal, and Ni atoms and W atoms in the substrate metal diffuse into the Co powder layer. In that case, the amount of the Ni atoms and the W atoms diffusing into the Co powder layer from the substrate metal is larger than the amount of the Co atoms diffusing into the substrate metal, and thus the substrate metal in contact with the Co powder layer is contracted. On the other hand, in the case of the Ni powder layer, the substrate metal expands in contrast to the case of the Co powder layer described as above. Therefore, when the Co powder layer and the Ni powder layer are simultaneously used, deformations due to these two actions are offset. The powders of Ni-Co alloy has the same action as that of the powder mixture of Ni and Co, because said diffusion is caused as the diffusions of Ni atoms and Co atoms.

Furthermore, the present invention provides a cathode for cathode ray tube of directly heating type, characterized by providing a metal layer of not more than 10% by weight of at least one of W and Mo, and not more than 1.5% by weight of Zr, the balance being at least one of Ni and Co on at least one side of a flat metal plate of Ni or Co-based alloy, heating the flat metal plate, thereby diffusing Ni and Co into the flat metal plate, and forming a compound plate, shaping a cathode substrate body in a cathode shape from the compound plate, laying powders of Ni-Co alloy or a powdery mixture of Ni and Co on the cathode substrate body, heating the cathode substrate body, thereby diffusing Ni and Co into the cathode substrate body, and then providing a thermionic emission layer thereon.

Thickness ($t$) of the flat metal plate of said alloy is properly determined in view of the successive plastic working. The flat metal plate of the alloy can be most preferably produced by shaping a powdery mixture of the respective constituent metal powders under pressure, then sintering the mixture, and cold rolling the sintered mixture. The thickness of the flat metal plate is determined also in view of its electrical resistance, but preferably 20 to 50 $\mu$m.

The metal layer comprising not more than 10% by weight of at least one of W and Mo, and not more than 1.5% by weight of Zr, the balance being at least one of Ni and Co means a metal layer consisting of at least one of Ni and Co, when the contents of W, Mo and Zr are zero.

When the thickness in total of the metal layers comprising at least one of Ni and Co at both face and back sides of flat metal plate is less than 1% of the thickness of the cathode substrate body, no effect is obtained upon the prevention of the thermal deformation, but when the thickness exceeds 15% of the thickness of the cathode substrate body, the electrical resistance of the entire cathode is lowered by formation of thick metal layer of Ni, Co, or Ni-Co having a small electrical resistance on the cathode substrate body having a large electrical resistance, and it takes a longer time in actuation as the cathode and at the same time fluctuations are large, cathode by cathode, though the thermal deformation can be prevented. Therefore, preferable thickness in total of the metal layers at both face and back sides of the cathode substrate body is 1 to 15% of the thickness of the cathode substrate body.

As a means for providing a dense metal layer of Ni, Co, or Ni-Co, such methods are available as by plating, vapor deposition, CVD, ion plating, foil or plate cladding, etc., but the plating method is most preferable.

Any of electrolytic plating method and chemical plating method can be used as the plating method. For example, in the case of Ni, electrolytic plating is carried out in the ordinary Ni plating bath, for example, a bath containing 150 g/l of nickel sulfate, 15 g/l of ammonium chloride, and 15 g/l of boric acid (pH 6.0) at a bath temperature of 25° C. and a current density of 1 A/dm$^2$. Also in the case of Co or Ni-Co alloy, the ordinary plating method is employed.

A layer of alloy can be provided as the metal layer, and a composition for the alloy metal constituents can be properly selected within the range for the alloy composition of the cathode substrate body. In the case of an alloy layer containing 5 to 10% by weight of W and not more than 1.5% by weight of Zr, the balance being at least one of Ni and Co, Zr has no effect upon the thermal deformation, and thus can be eliminated, but W or Mo has an effect upon the thermal deformation. That is, an alloy can be properly selected from the systems Ni-W, Ni-Mo, Ni-W-Mo, Ni-Co-W, Ni-Co-Mo, and Ni-Co-W-Mo, and further an alloy can be properly selected from the alloys of these systems further containing Zr. The layer of these alloys can be provided on the cathode substrate body in the same manner as in the case of the Ni layer. Especially, a desirable foil or plate of these alloys can be produced by sintering a mixture of Ni, Co, W, Mo, and Zr powders in a desired mixing ratio into a plate, for example, 10 mm thick × 80 mm wide × 150 mm long, cold rolling and annealing in vacuum the resulting plate (the annealing conditions: 800° to 1,000° C., and $10^{-5}$ torr or less) to several repetitions, for example, in such steps as 5 mm thick × 80 mm wide × 250 mm long → 2 mm thick × 80 mm wide × 700 mm long → 1 mm thick × 80 mm wide × 1,300 mm long → 0.4 mm thick × 80 mm wide × 2,500 mm long.

When a layer of not more than 10% by weight of at least one of Mo and W and not more than 1.5% by weight of Zr, the balance being at least one of Ni and Co, that is, a metal layer of at least one of Ni and Co, or a metal layer of alloy containing Mo, W and Zr in addition to these is provided on the metal flat plate, and then heated in vacuum, mutual diffusion of Ni and Co, and W, Mo, and Zr takes place between the layer and the flat metal plate, and a diffusion layer having a gradually sloped change in concentrations of Ni, Co, W, Mo, and Zr can be formed. By the heat treatment a room for the thermal deformation can be eliminated.

A preferable embodiment of the present invention provides a cathode for cathode ray tube of directly heating type, which comprises a cathode substrate body having two leg pieces extended in the same direction, and a flat part connected to one end of each leg piece, prepared by forming on a flat metal plate of 25 to 30% by weight of tungsten or molybdenum singly or 25 to 30% by weight in total of tungsten and molybdenum in combination, 0.2 to 0.8% by weight of zirconium, the balance being nickel or cobalt a plating layer of at least one of nickel and cobalt 1 to 15% as thick as the flat metal plate by diffusion bonding, thereby forming a compound plate, and then shaping the compound plate; a bonding layer having an uneven surface, to which a thermionic emission layer is to be bonded, prepared by diffusion bonding a layer of powders of alloy or powdery mixture of 35 to 65% by weight of Ni and 65 to 35% by weight of Co onto an outer surface of the flat part by heating; and the themionic emission layer formed on said bonding layer.

In said cathode, the present invention is further characterized by diffusion bonding the metal layer onto the flat metal plate, then subjecting the diffusion bonded flat metal plate to plastic working to a desired thickness, thereby forming a compound plate, and using a cathode substrate body formed from the compound plate, and especially cold rolling is carried out as the plastic working to a desired thickness, for example, 30 μ thick, thereby preparing a cathode substrate body corresponding to 1 in FIG. 1. To obtain the desired thickness, the cold rolling is carried out by two repetitions of cold rolling and vacuum annealing in the following order, if the thickness of the compound plate having a diffusion layer thereon is 1 mm.

1 mm thick → 0.4 mm thick → 0.03 mm thick

A cathode substrate body in cathode shape is prepared from the compound plate by punching, and Ni and Co powders are placed on the cathode substrate body. Then, the substrate body is heated to form a diffusion layer of Ni and Co, and then a solution of compound carbonate of barium, strontium and calcium, is applied to the substrate body. Then, the substrate body is calcined at a high temperature to convert the carbonate to its compound oxides, and a thermionic emission layer is formed thereby.

Now, the present invention will be described in detail, referring to Examples, but will never be restricted to these Examples.

EXAMPLE 1

Cathode substrate bodies corresponding to numeral 1 in FIG. 1 were prepared by punching from an alloy plate of 28% by weight of W, and 0.4% by weight of Zr, the balance being Ni, an alloy plate of 10% by weight of Co, 28% by weight of W and 0.4% by weight of Zr, the balance being Ni, and an alloy plate of 30% by weight of Co, 28% by weight of W and 0.4% by weight of Zr, the balance being Ni, respectively, each plate having a thickness of 30 μ, and were used as test cathode substrate bodies.

Powders of Ni-Co alloy and powdery mixtures of Ni and Co having various compositions, and single Ni powders and single Co powders as comparative examples were applied to the test cathode substrate bodies in a density range of 2 to 4 mg/cm$^2$, heated at 900° C. in vacuum for 30 minutes to bake the powders. Then, deformations Δl were measured. The deformation Δl represents a bending of cathode, and a bending in the expanding direction of cathode substrate body is designated by +Δl, and that in the contracting direction by −Δl.

FIG. 3 shows fractions of ranges in which the thermal deformations Δl of the respective tests can be plotted on the basis of compositions of Ni and Co.

Bending of NI (100%), that is, single Ni powders is +Δl of 25–35 μ in FIG. 3, and that of Co (100%), that is, single Co powders is −Δl of 20–33 μ.

On the other hand, in the embodiments of the present invention, the bending Δl is changed by composition ratio of Ni and Co, but compositions of alloy constituting substrate metal, and differences between the Co-Ni alloy and the mixture of Ni and Co have less influence upon the bending. For example, in such ranges as 35 to 65% by weight of Co and 65 to 35% by weight of Ni, all the bendings are in a range of measurement error of 2 to 3 μ.

(Ba, Sr, Ca)$CO_3$ was applied to the test pieces, to which the powders in a range of 35 to 65% by weight of Co and 65 to 35% by weight of Ni were baked, to a thickness of 2 mg/cm$^2$ without correcting the bending developed by the baking, and heated at 1000° C. for 30 minutes to form a thermionic emission layer.

The bendings Δl of the resulting cathode were in a range of measurement error of 2 to 3 μ. Similarly a thermionic emission layer was formed in the case of the single Ni powders, and the bending was measured. Δl was in a range of 40 to 55 μ.

EXAMPLE 2

A powdery mixture of 40% by weight of Ni and 60% by weight of Co was applied to both sides of a test cathode substrate body shaped from an alloy plate of 28% by weight of W and 0.4% by weight of Zr, the balance being Ni having a thickness of 30 μ to a thickness of 2 to 4 mg/cm$^2$, and baked in the same manner as in Example 1. Bending Δl was measured. It was in a measurement error range of about 1 μ in +Δl to −Δl.

EXAMPLE 3

Powdery mixtures of 75% by weight of nickel and 25% by weight of Co, and 50% by weight of Ni and 50% by weight of Co were applied to a thickness of 2 mg/cm$^2$ to both sides of cathode substrate bodies of an alloy of 28% by weight of W and 0.4% by weight of Zr, the balance being Ni, having a thickness of 30 μ, which were subjected to Ni plating at both sides to a thickness of 0.5 μ (thickness at one side), and baked by heating at 800° C. in vacuum for 30 minutes. Further (Ba.Sr.Ca)-$CO_3$ was applied to the substrate bodies to a thickness of 2 mg/cm$^2$, and heated at 1,000° C. for 6 hours to form a thermionic emission layer. Then, deformations of the resulting cathodes were measured in the same manner as in Example 1.

Thermal deformation of the cathode substrate bodies was very small, and was within the range of measurement errors even when any of powders of alloy or mixture of 75% by weight of Ni and 25% by weight of Co, and 50% by weight of Ni and 50% by weight of Co was baked thereon.

EXAMPLE 4

A flat metal plate of alloy of 28% by weight of W and 0.4% by weight of Zr, the balance bing Ni, having a thickness of 0.35 mm was subjected to Ni plating at one side to a thickness of 30 μ, and heated at 1,000° C. in vacuum for 15 hours to form a diffusion layer. The resulting compound plate was cold rolled to a thickness of 30 μ, and a cathode substrate body was punched out from the compound plate. Then, a thermionic emission layer was formed, using a powdery mixture of 50% by weight of Ni and 50% by weight of Co in the same manner as in Example 2. In the present Example, the Ni plating and the cold rolling were carried out according to the ordinary procedures.

Δl after the baking of the powdery mixture and Δl after the formation of the thermionic emission layer were measured, and were in the range of measurement error.

EXAMPLE 5

An alloy plate of 10% by weight of W and 0.4% by weight of Zr, the balance being Ni, having a thickness of 1 mm, was placed on one side of a flat metal plate of alloy of 28% by weight of W and 0.4% by weight of Zr, the balance being Ni, having a thickness of 10 mm formed by powder metallurgy, and heated at 1,000° C. in vacuum for 20 hours to form a diffusion layer. The resulting compound plate was cold rolled to a thickness of 30 μ, and a cathode substrate body was shaped by punching from the compound plate. A thermionic emission layer was provided on the cathode substrate body using a powdery mixture of 50% by weight of Ni and 50% by weight of Co in the same manner as in Example 2. Δl after the baking of the Ni-Co powders, Δl after the baking of the thermionic emission layer, and further Δl after heating at 800° C. in vacuum for 100 hours were all in the range of measurement errors.

Similar results where obtained when the alloy plates of 10% by weight of W and 0.4% by weight of Zr, the balance being Ni, having a thickness of 1 mm were placed on both sides of the flat metal plate.

When the cathode prepared in Example 1 (baking of a powdery mixture of 60% by weight of Co and 40% by weight of Ni) was actually mounted in a color television, any influence by thermal deformation right after put into service was not observed.

It is obvious from the foregoing Examples that the present invention can completely prevent thermal deformation of cathode, which is a fatal damage to the cathode ray tube of directly heating type.

What is claimed is:

1. A cathode for cathode ray tube of directly heating type comprising a cathode substrate body having two leg pieces extended in the same direction and a flat part connected to one end of each leg piece, prepared by shaping a flat metal plate of nickel- or cobalt-based alloy; a bonding layer comprising heat-diffusible metals having an affinity to said flat metal plate, and having an uneven surface, formed on an outer surface of said flat part by diffusion bonding, to whose surface a thermionic emission layer is to be bonded, and the thermionic emission layer formed on the surface of the bonding layer, wherein an improvement comprises the bonding layer consisting of nickel and cobalt.

2. A cathode according to claim 1, wherein the bonding layer consists of 35 to 65% by weight of nickel and 65 to 35% by weight of cobalt.

3. A cathode according to claim 1, wherein said flat metal plate is comprised of an alloy of 15 to 30% by weight of at least one of tungsten and molybdenum, and 0.1 to 1.5% by weight of zirconium, the balance being nickel or cobalt.

4. A cathode for cathode ray tube of directly heating type, which comprises a cathode substrate body having two leg pieces extended in the same direction and a flat part connected to one end of each leg piece, prepared by shaping a flat metal plate of 25 to 30% by weight of tungsten or molybdenum alone, or 25 to 30% by weight in total of tungsten and molybdenum in mixture, and 0.2 to 0.8% by weight of zirconium, the balance being nickel or cobalt; a bonding layer of 35 to 65% by weight of nickel and 65 to 35% by weight of cobalt having an uneven surface, formed on an outer surface of said flat part by diffusion bonding, to whose surface a thermionic emission layer is bonded; and the thermionic emission layer formed on the surface of said bonding layer.

5. A cathode according to claim 4, wherein the metal layer consists of not more than 10% by weight of at least one of tungsten and molybdenum, and not more than 1.5% by weight of zirconium, the balance being at least one of nickel and cobalt.

6. A cathode according to claim 4, wherein the bonding layer consists of 35 to 65% by weight of nickel and 35 to 65% by weight of cobalt.

7. A cathode according to claim 4, wherein said flat metal plate is comprised of an alloy of 15 to 30% by weight of at least one of tungsten and molybdenum, and 0.1 to 1.5% by weight of zirconium, the balance being nickel or cobalt.

8. A cathode for cathode ray tube of directly heating type, which comprises a cathode substrate body having two leg pieces extended in the same direction and a flat part connected to one end of each leg piece, prepared by shaping a compound plate formed by diffusion bonding to a flat metal plate of nickel- or cobalt-based alloy a metal layer having an affinity to said flat metal plate; a bonding layer of nickel and cobalt, formed on an outer surface of said flat part by diffusion bonding, having an uneven surface, to whose surface a thermionic emission layer is to be bonded; and the thermionic emission layer formed on the surface of the bonding layer.

9. A cathode for cathode ray tube of directly heating type, which comprises a cathode substrate body having two leg pieces extended in the same direction and a flat part connected to one end of each leg piece, prepared by shaping a compound plate formed by diffusion bonding to a flat metal plate of 25 to 30% by weight of tungsten or molybdenum alone, or 25 to 30% by weight in total of tungsten and molybdenum in mixture, and 0.2 to 0.8% by weight of zirconium, the balance being nickel or cobalt a plating layer of at least one of nickel and cobalt 1 to 15% as thick as the flat metal plate; a bonding layer of 35 to 65% by weight of nickel and 65 to 35% by weight of cobalt having an uneven surface, formed on an outer surface of said flat part by diffusion bonding, to whose surface a thermionic emission layer is bonded; and the thermionic emission layer formed on the surface of said bonding layer.

10. A cathode for cathode ray tube of directly heating type, which comprises a cathode substrate body having two leg pieces extended in the same direction and a flat part connected to one end of each leg piece, prepared by forming on a flat metal plate of nickel- or cobalt-based alloy a metal layer having an affinity to the flat metal plate by diffusion bonding, then applying a plastic working to the flat metal plate, thereby forming a compound plate, and shaping the compound plate; a bonding layer of nickel and cobalt, formed on an outer surface of said flat part by diffusion bonding, having an uneven surface, to whose surface a thermionic emission layer is to be bonded; and the thermionic emission layer formed on the surface of the bonding layer.

11. A cathode according to claim 10, wherein said flat metal plate is comprised of an alloy of 15 to 30% by weight of at least one of tungsten and molybdenum, and 0.1 to 1.5% by weight of zirconium, the balance being nickel or cobalt.

12. A cathode according to claim 10, wherein the bonding layer consists of 35 to 65% by weight of nickel and 35 to 65% by weight of cobalt.

13. A cathode according to claim 10, wherein the metal layer consists of not more than 10% by weight of at least one of tungsten and molybdenum, and not more than 1.5% by weight of zirconium, the balance being at least one of nickel and cobalt.

14. A cathode for cathode ray tube of directly heating type, which comprises a cathode substrate body having two leg pieces extended in the same direction and a flat part connected to one end of each leg piece, prepared by shaping a compound plate formed by diffusion bonding to a flat metal plate of 25 to 30% by weight of tungsten or molybdenum alone, or 25 to 30% by weight in total of tungsten and molybdenum in mixture, and 0.2 to 0.8% by weight of zirconium, the balance being nickel or cobalt a plating layer of at least one of nickel and cobalt 1 to 15% as thick as the flat plate, then cold rolling the flat metal plate to a desired thickness, thereby forming a compound plate, and shaping the compound plate; a bonding layer of 35 to 65% by weight of nickel and 65 to 35% by weight of cobalt having an uneven surface, formed on an outer surface of said flat part by diffusion bonding, to whose surface a thermionic emission layer is bonded; and the thermionic emission layer formed on the surface of said bonding layer.

15. A process for producing a cathode for cathode ray tube of directly heating type, which comprises shaping a flat metal plate of nickel- or cobalt-based alloy into a cathode substrate body having two leg pieces extended in the same direction and a flat part connected to one end of each leg piece; forming a heat-diffusible metal powder layer having an affinity to said flat metal plate on an outer surface of said flat part, heating the powder layer, thereby diffusion bonding the powder layer to the flat part and forming a bonding layer having an uneven surface, to whose surface a thermionic emission layer is to be bonded; and forming the thermionic emission layer on the bonding layer, wherein an improvement comprises said bonding layer being comprised of powders of nickel- cobalt alloy or powdery mixture of nickel and cobalt.

16. A process according to claim 15, wherein said powdery layer of powders of nickel-cobalt alloy or powdery mixture of nickel and cobalt has a composition of 35 to 65% by weight of nickel and 65 to 35% by weight of cobalt.

17. A process according to claim 15, wherein said flat metal plate is comprised of an alloy of 15 to 30% by weight of at least one of tungsten and molybdenum, and 0.1 to 1.5% by weight of zirconium, the balance being nickel or cobalt.

18. A process for producing a cathode for cathode ray tube of directly heating type, which comprises shaping a flat metal plate of 25 to 30% by weight of tungsten or molybdenum alone or 25 to 30% by weight in total of tungsten and molybdenum in mixture, and 0.2 to 0.8% by weight of zirconium, the balance being nickel or cobalt into a cathode substrate body having two leg pieces extended in the same direction and a flat part connected to one end of each leg piece; forming a powder layer of alloy powders or powdery mixture of 35 to 65% by weight of nickel and 65 to 35% by weight of cobalt on an outer surface of said flat plate, and heating said powder layer, thereby diffusion bonding said powder layer to said flat part and forming a bonding layer having an uneven surface, to whose surface a thermionic emission layer is to be bonded; and forming the thermionic emission layer on the surface of the bonding layer.

19. A method according to claim 18, wherein said metal layer consists of not more than 10% by weight of at least one of tungsten and molybdenum, and not more than 1.5% by weight of zirconium, the balance being at least one of nickel and cobalt.

20. A process for producing a cathode for cathode ray tube of directly heating type, which comprises shaping a compound plate prepared by diffusion bonding onto a flat metal plate of nickel- or cobalt-based alloy a metal layer having an affinity to said flat metal plate into a cathode substrate body having two leg pieces extended in the same direction, and a flat part connected to one end of each leg piece; forming a powder layer of powders of nickel-cobalt alloy or powdery mixture of nickel and cobalt on an outer surface of said flat part, and heating said powder layer, thereby diffusion bonding said powder layer to said flat part and forming a bonding layer having an uneven surface, to whose surface a thermionic emission layer is to be bonded; and forming the thermionic emission layer on the surface of the bonding layer.

21. A process according to claim 19, wherein said powder layer of powders of nickel-cobalt alloy or powdery mixture of nickel and cobalt has a composition of 35 to 65% by weight of nickel and 65 to 35% by weight of cobalt.

22. A process according to claim 20, wherein said flat metal plate is comprised of an alloy of 15 to 30% by weight of at least one of tungsten and molybdenum, and 0.1 to 1.5% by weight of zirconium, the balance being nickel or cobalt.

23. A process for producing a cathode for cathode ray tube of directly heating type, which comprises diffusion bonding onto a flat metal plate of 25 to 30% by weight of tungsten or molybdenum alone or 25 to 30% by weight in total of tungsten and molybdenum in mixture, and 0.2 to 0.8% by weight of zirconium, the balance being nickel or cobalt a plating layer of at least one of nickel and cobalt 1 to 15% as thick as said flat metal plate, thereby forming a compound plate, shaping the compound plate into a cathode substrate body having two leg pieces extended in the same direction and a flat part connected to one end of each leg piece; forming a powder layer of alloy powders or powdery mixture of 35 to 65% by weight of nickel and 65 to 35% by weight of cobalt on an outer surface of said flat plate, and heating said powder layer, thereby diffusion bonding said powder layer to said flat part and forming a bonding layer having an uneven surface, to whose surface a thermionic emission layer is to be bonded; and forming the thermionic emission layer on the surface of the bonding layer.

24. A process for producing a cathode for cathode ray tube of directly heating type, which comprises shaping a compound plate prepared by diffusion bonding onto a flat metal plate of nickel- or cobalt-based alloy a metal layer having an affinity to said flat metal plate and plastic working the flat metal plate to a desired thickness into a cathode substrate body having two leg pieces extended in the same direction, and a flat part connected to one end of each leg piece; forming a powder layer of powders of nickel-cobalt alloy or powdery mixture of nickel and cobalt on an outer surface of said flat part, and heating said powder layer, thereby diffusion bonding said powder layer to said flat part and forming a bonding layer having an uneven surface, to whose surface a thermionic emission layer is to be bonded; and forming the thermionic emission layer on the surface of the bonding layer.

25. A process according to claim 24, wherein said flat metal plate is comprised of an alloy of 15 to 30% by weight of at least one of tungsten and molybdenum, and 0.1 to 1.5% by weight of zirconium, the balance being nickel or cobalt.

26. A process according to claim 24, wherein said powder layer of powders of nickel-cobalt alloy or powdery mixture of nickel and cobalt has a composition of 35 to 65% by weight of nickel and 65 to 35% by weight of cobalt.

27. A method according to claim 24, wherein said metal layer consists of not more than 10% by weight of at least one of tungsten and molybdenum, and not more than 1.5% by weight of zirconium, the balance being at least one of nickel and cobalt.

28. A process for producing a cathode for cathode ray tube of directly heating type, which comprises diffusion bonding onto a flat metal plate of 25 to 30% by weight of tungsten or molybdenum alone or 25 to 30% by weight in total of tungsten and molybdenum in mixture, and 0.2 to 0.8% by weight of zirconium, the balance being nickel or cobalt a plating layer of at least one of nickel and cobalt 1 to 15% as thick as said flat metal plate, cold rolling the flat metal plate to a desired thickness, thereby forming a compound plate, shaping the compound plate into a cathode substrate body having two leg pieces extended in the same direction and a flat part connected to one end of each leg piece; forming a powder layer of alloy powders or powdery mixture of 35 to 65% by weight of nickel and 65 to 35% by weight of cobalt on an outer surface of said flat plate, and heating said powder layer, thereby diffusion bonding said powder layer to said flat part and forming a bonding layer having an uneven surface, to whose surface a thermionic emission layer is to be bonded; and forming the thermionic emission layer on the surface of the bonding layer.

29. A process according to claim 28, wherein said flat metal plate is prepared by powder metallurgy.

* * * * *